US007004807B1

(12) United States Patent
Summers

(10) Patent No.: US 7,004,807 B1
(45) Date of Patent: Feb. 28, 2006

(54) THROWABLE EMERGENCY RESPONSE AUTOMATIC INFLATABLE PERSONAL FLOTATION DEVICE

(76) Inventor: Michael S. Summers, 59821 Rd. 601, Ahwahnee, CA (US) 93601

( * ) Notice: Subject to any disclaimer, the term of this patent is extended or adjusted under 35 U.S.C. 154(b) by 0 days.

(21) Appl. No.: 10/928,444

(22) Filed: Aug. 26, 2004

(51) Int. Cl.
*B63C 9/08* (2006.01)

(52) U.S. Cl. ..... 441/81

(58) Field of Classification Search ..... 441/80, 441/81

See application file for complete search history.

(56) References Cited

U.S. PATENT DOCUMENTS

| | | | | |
|---|---|---|---|---|
| 2,353,933 | A | 7/1944 | Schneider | |
| 2,894,658 | A | 7/1959 | Spidy | |
| 3,693,202 | A | 9/1972 | Ohtani | |
| 3,809,288 | A | 5/1974 | Mackal | |
| 3,828,381 | A | 8/1974 | Prager | |
| 3,997,079 | A | 12/1976 | Niemann | |
| 4,063,323 | A | 12/1977 | Salvarezza | |
| 4,094,028 | A * | 6/1978 | Fujiyama et al. | 441/31 |
| 4,223,805 | A | 9/1980 | Mackal | |
| 4,260,075 | A | 4/1981 | Mackal | |
| 4,267,944 | A | 5/1981 | Mackal | |
| 4,627,823 | A | 12/1986 | Mackal | |
| 4,768,128 | A | 8/1988 | Jankowiak et al. | |
| 5,199,374 | A | 4/1993 | Blanchette | |
| 5,400,922 | A | 3/1995 | Weinheimer et al. | |
| 6,589,087 | B1 | 7/2003 | Mackal et al. | |

OTHER PUBLICATIONS

Deck Crew (Automatic Inflation Device), Internet, 2004, Conax florida.

* cited by examiner

*Primary Examiner*—Jesus D. Sotelo
(74) *Attorney, Agent, or Firm*—Richard A. Ryan

(57) ABSTRACT

An automatic inflatable personal flotation device configured to be thrown to a person in a body of water to assist that person with staying afloat while waiting to be rescued. The flotation device is configured with a body member having a handle configured to be easily and effectively thrown. The body member supports an automatic inflator assembly and a source of pressurized gas, such as a cylinder of carbon dioxide. The inflator assembly is configured to automatically activate upon immersion in water and release the pressurized gas to rapidly fill a flotation bladder, pneumatically connected to the inflator assembly, with the gas to support the person in the water. A pull handle and cord member mechanism provides for manual activation of the inflator assembly. A sheath covers the flotation bladder during storage and while thrown. The handle can have a chamber for storing various signal generating devices or emergency materials.

20 Claims, 5 Drawing Sheets

THROWABLE EMERGENCY RESPONSE AUTOMATIC INFLATABLE PERSONAL FLOTATION DEVICE

CROSS-REFERENCE TO RELATED APPLICATIONS

None.

BACKGROUND OF THE INVENTION

A. Field of the Invention

The field of the present invention relates generally to emergency flotation devices adapted to assist in the rescue of persons in bodies of water. More particularly, the present invention relates to such emergency flotation devices that are configured to be easily throwable and which automatically inflate upon contact with the body of water. Even more particularly the present invention relates to such emergency flotation devices which have a generally baton-shaped body member for throwing and a flotation component configured to support a person in the body of water.

B. Background

Accidental drowning is an unfortunate risk of most recreational or occupational activities, such as boating, swimming and the like, that take place around or in bodies of water, including lakes, rivers, canals, and oceans. Accidental drowning is also a substantial risk during natural disasters, such as floods, and transportation accidents over a body of water, such as airplane crashes, sinking boats and the like. Generally, all such drownings begin with a person falling or thrown into the body of water and then being unable to swim or otherwise make it to safety, which may be the shore or a structure or other safe location (i.e., a raft or boat) in the water, due to their inability to swim, swim the required distance or swim in the water conditions (i.e., cold, choppy water, etc.). For many drowning events, there is some period of time between when a person falls or is thrown into the water and when the person drowns in which help could be provided to him or her by others that would prevent the drowning. Typically, this help is in the form of providing the person in the water a personal flotation device that is suitable for safely supporting the person in the water until a more permanent rescue can be effectuated (i.e., pulling the person out of the water or being picked up by boat or helicopter). Common types of personal flotation devices, which are configured, adapted and/or intended for use by a single person as opposed to a group of persons (i.e., which require a large life raft or the like), include life jackets or vests, cushions, rings and horseshoe configured devices. The purpose of a personal flotation device is to keep a person afloat until he or she is rescued. It is generally not a purpose of such devices to provide a water craft for sustained use in and/or movement through the water.

While such devices generally are well suited for providing a person in the water with a way to keep afloat without tiring (i.e., from treading water) until he or she is rescued, they do have some substantial drawbacks that limit their effectiveness in many situations. Life jackets must be on the person before he or she falls into the water and becomes a potential drowning victim, or he or she must be able to put the life jacket on while in the water (i.e., while treading water or the like). Unfortunately, due to the circumstances of the entry into the water or the water conditions, the person may be unable to put the life jacket on or put it on in a manner such that it stays on. Obviously, a person who is seriously injured or otherwise unable to manipulate a life jacket while in the water is not able to take advantage of being provided with the life jacket. In addition, most life jackets, cushions, rings or horseshoe devices are difficult to throw very far or with any accuracy. As such, if a person falls into the water and someone is able to throw a typical personal flotation device to them, it is not uncommon for the person throwing the device to not be able to throw it very far or with any accuracy. As known to those skilled in the art, including rescue personnel and life guards, there is a certain amount of skill involved, which typically takes training to acquire, in order to effectively throw a personal flotation device to a drowning person. As such, these devices often do little to assist the person who is more than 50 feet or so from shore, structure, vessel or other safe location.

For storage and delivery (i.e., throwing) purposes, many personal flotation devices are stored without air inside them, which requires the rescuer or the person in the water to fill the device with air before it can be effectively utilized. As discussed above, often it can be very difficult for the person in the water to place the required quantity of air, such as by blowing, into the personal flotation device and many rescuers may not have or take the time to fill it before throwing. A number of personal flotation devices were developed that allow the person in the water to quickly fill the device with the amount of air necessary for the device to be effectively utilized. Generally, these personal flotation devices include a source of pressurized gas, a bladder that is suitable for receiving the pressurized gas and supporting the person in the water and some type of switch or other activating mechanism for initiating the flow of pressurized gas from the source to the bladder. An example of such a device is shown in U.S. Pat. No. 3,828,381 to Prager and an example of a manual inflation manifold is disclosed in U.S. Pat. No. 3,809,288 to Mackal. The source of pressurized gas is typically a canister or other container having carbon dioxide or other non-flammable and non-toxic gas that is under sufficient pressure to rapidly fill the bladder to provide a support for the person in the water while he or she waits for a more permanent rescue. Although the activating mechanisms used with most such devices generally appear to be easy to operate when viewed safely on shore or other places where there is no risk of drowning and no water conditions (i.e., waves, rain, etc.) to deal with, under real potentially drowning conditions, the person in the water may have difficulty in operating the activating mechanism so as to fill the bladder with air.

To overcome the problems associated with personal flotation devices that require manual operation of an activating mechanism, various improved personal flotation devices have been developed that include automatic activating mechanisms or inflators that are configured to automatically transfer gas from the source of pressurized gas to the bladder upon exposure to water. These devices typically comprise a gas cartridge having a pierceable or frangible seal and a spring loaded piercing pin that is driven into the seal to cause compressed gas to flow from the canister to a manifold that pneumatically connects to the bladder to be inflated. The typical mechanism for driving the piercing pin is a cam that is driven by a water activated trigger assembly that includes either a water destructible or dissolvable element or cartridge that, in the set position before exposure to the water, retains an actuator pin in a cocked or ready position in alignment with the piercing pin. Examples of some automatic inflators which utilize water destructible or dissolvable elements to trigger the piercing pin are set forth in various patents to Mackal, et al. (i.e., U.S. Pat. Nos. 6,705,488; 6,589,087; 4,627,823; 4,223,805; 4,267,944; and 4,260,075), U.S. Pat. No. 2,894,658 to Spidy, U.S. Pat. No. 3,526,339 to Bernhardt, et al. and U.S. Pat. No. 3,997,079 to Niemann. When these trigger assemblies are exposed to water, the dissolvable elements dissolve to release the piercing pin and fracture the seal of the cylinder to release the pressurized gas into the inflatable bladder portion of the flotation device. As noted in U.S. Pat. No. 4,627,823 to Mackal, a major disadvantage of some of these prior art devices was their tendency to self-actuate, causing premature and unintentional inflation of the inflatable bladder during storage, particularly in the humid environments typically found on ships or near bodies of water. The device of this Mackal patent (U.S. Pat. No. 4,627,823) is configured to be housed in a bracket assembly for attachment to a stationary object such that when the device is released from the bracket, the actuator is mechanically cocked to arm the device for use.

An alternative to the water destructible or dissolvable elements utilized in the personal flotation devices described above are devices which utilize electrically operated actuation assemblies, such as those described in U.S. Pat. No. 4,768,128 to Jankowiak, et al. and U.S. Pat. No. 5,400,922 to Weinheimer, et al. The patent to Jankowiak describes a water activated pressurized gas release device configured to inflate personal flotation equipment when immersed in water. The actuation assembly has a battery operated circuit that operates by completing the circuit when the device is immersed in water to ignite an explosive primer so as to drive the piercing pin into the pierceable closure on the container holding the pressurized gas. A device made according to this patent is commercially available as the "Deck Crew" automatic inflation device from Conax Florida Corporation out of St. Petersburg, Fla. The patent to Weinheimer describes a automatic inflator for personal flotation devices that utilizes a battery-powered, water-sensing electrical circuit that supplies power to a fusible link actuator assembly upon immersion of the device in water. Upon immersion in water, the electrical circuit fuses a fuse bolt to allow a spring to force a slidable link forward within the actuator so as to force the firing lever to move upward and forcibly urge the firing pin to pierce the frangible seal of the gas cartridge.

One significant disadvantage of the prior art automatic inflating personal flotation devices is their inability to be easily deployed by throwing during an emergency situation, such as a potential drowning. In general, the prior art devices are too bulky and/or weight too much to be easily and effectively thrown any substantial distance by the typical person. As with the early and still most common personal flotation devices, the standard, non-inflatable rings and horseshoe devices, the prior art automatic inflating personal flotation devices are not easy to throw more than a relatively short distance, particularly with any accuracy. Another significant disadvantage of many of the prior art automatic inflating personal flotation devices is that they can be difficult to conveniently and safely store while waiting use. Another disadvantage of some prior art devices having enclosed housings is the positioning of the manual "back-up" actuator inside the enclosed cartridge, which requires the cartridge to open before the back-up can be utilized.

What is needed, therefore, is an improved automatic inflatable personal flotation device that is easier for the average person, particularly untrained persons, to throw an effective distance with accuracy. The preferred automatic inflatable personal flotation device will automatically inflate upon contact with water and, in case of malfunction of the automatic actuator, be easy for the potentially drowning person to manually actuate. The preferred automatic inflatable personal flotation device will be made out of materials that are generally lightweight, durable, suitable for use in outdoor environments and be configured for use with either an electrically operated actuator or an actuator using a destructible or dissolvable element to automatically actuate a piercing pin capable of piercing a frangible seal on a pressurized gas cartridge. The preferred automatic inflatable personal flotation device of the present invention will also include a body member having a handle portion suitable for storing one or more signal generating devices, such as a global positioning satellite ("GPS") locator, strobe light, liquid florescent light, dye marker, whistle, air horn, smoke signal and/or a distress flag, and/or one or more emergency materials, such as shark repellant, medicines, first aid supplies and/or a knife. Ideally, the preferred automatic inflatable personal flotation device should be relatively inexpensive to manufacture and adaptable for a variety of different emergency uses.

SUMMARY OF THE INVENTION

The throwable emergency response automatic inflatable personal flotation device of the present invention solves the problems and provides the benefits identified above. That is to say, the present invention discloses a new and improved automatic inflatable personal flotation device that is relatively easy for the average person to throw a further distance with reasonable accuracy. The automatic inflatable personal flotation device of the present invention is made out of materials and configured to facilitate the average person being able to throw the device a relatively greater distance with accuracy and to automatically inflate the bladder portion of the device upon contact with a body of water so as to provide a personal flotation device for a person in the water. In case the automatic actuator malfunctions, the device of the present invention is provided with a simple to use and effective manual actuating mechanism. In the preferred embodiment of the present invention, the device is configured similar to a baton and includes a foam covering that covers and secures the various components of the device. The preferred embodiment of the device of the present invention includes a body member having a handle portion configured to removably store one or more signaling generating devices. Also in the preferred embodiment, the device of the present invention is relatively inexpensive to make, durable and suitable for use in a variety of outdoor environments.

The automatic inflatable personal flotation device of the present invention may be utilized with a variety of air-fillable personal flotation bladders, including a ring or horseshoe shaped bladder or life preserver component to be placed around or grasped by a person in a body of water who is or could be a potential drowning victim. In addition, the device of the present invention can be utilized with appropriately sized life vests, rafts and other bladder-types of flotation devices. Preferably, the handle of the body member has a chamber that is configured for storing one or more signal generating devices, including but not limited to a GPS locator, strobe light, liquid florescent light, dye marker, whistle, air horn, smoke signal and/or distress flag, and/or one or more emergency materials, such as shark repellant, medicines, first aid supplies and/or a knife.

In one general aspect of the present invention, the automatic inflatable personal flotation device of the present invention includes a substantially baton-shaped body member that has a handle section, an actuator section and a cylinder section for supporting the various components of the flotation device. A handle is located at the handle section, an inflator assembly is located at the actuator section and a source of pressurized gas is at the cylinder section. A flotation bladder is generally disposed about, preferably wrapped around, at least a portion of the body member and pneumatically connected to the inflator assembly. The source of pressurized gas contains a pressurized gas therein to fill the flotation bladder. The inflator assembly is at least partially disposed in a flooding chamber that has one or more flooding openings hydraulically connected thereto to allow water from a body of water to contact the inflator assembly. The inflator assembly, which is preferably either a battery operated electrical mechanism or a water destructible and/or dissolvable element mechanism, is configured to operatively contact the source of pressurized gas so as to release the pressurized gas therefrom. The pressurized gas flows from the source of pressurized gas through a manifold in the inflator assembly to the inflatable flotation bladder, which is configured to be filled by the pressurized gas when released from the source of pressurized gas.

In the preferred embodiment of the automatic inflatable personal flotation device of the present invention, the flotation device is configured for use by a rescuer to assist a person in a body of water by throwing the flotation device to the person in the water. To facilitate throwing, the substantially baton-shaped body member has a handle section with a handle configured to be gripped by the hand of the rescuer and thrown by the rescuer to the person in the body of water. The handle can have an interior chamber configured for storage of one or more signal generating devices, including but not limited to a GPS locator, strobe light, liquid florescent light, dye marker, whistle, air horn, smoke signal and/or distress flag, and/or one or more emergency materials, such as shark repellant, medicines, first aid supplies and/or a knife. The source of pressurized gas can be a cylinder of carbon dioxide or other gas that has a pierceable or frangible seal at one end of the cylinder. The cylinder can be supported on the body member by a cylinder support bracket positioned at the cylinder section. The support bracket can have a pair of outwardly extending bracket members that fixedly or removably retain the cylinder on the body member. The inflator assembly is at least partially disposed in a flooding chamber having one or more flooding openings to allow water from the body of water to contact the inflator assembly and activate the inflator assembly to operatively contact the cylinder and release the pressurized gas therefrom. As referenced above, the inflator assembly is preferably either a battery operated electrical mechanism or a water destructible and/or dissolvable element mechanism. One or more actuator positioning tabs are on the body member and in cooperating relationship with the inflator assembly to properly position the inflator assembly thereon. In the non-activated condition, the flotation bladder is disposed about at least a portion of the body member and pneumatically connected to the inflator assembly. When the inflator assembly is activated, it fills the flotation bladder with the pressurized gas to provide a floating device to assist the person in the body of water. In case the automatic inflator assembly fails, the device has a mechanism for manual inflation of the flotation bladder that is operatively connected to the inflator assembly to allow the person in the water to manually operate the inflator assembly to fill the flotation bladder with the pressurized gas. A covering sheath is utilized to at least cover the flotation bladder and maintain the flotation bladder around the body member until the device contacts the body of water. This provides improved aerodynamics for a further throwing distance. To ensure that the flotation device opens upon contact with the water, the covering sheath should have a compromised seam or other mechanism that is configured to separate the covering sheath and release the flotation bladder. The flotation bladder has a back-up air fill tube in airflow communication with the interior of the flotation bladder for use by the person in the water to fill the flotation bladder by blowing air into it. The flotation bladder can have one or more user handles to help the person in the water hold on to the inflated bladder and/or one or more rescue handles to help a rescuer pull the person from the water.

Accordingly, the primary objective of the present invention is to provide a throwable emergency response automatic inflatable personal flotation device that provides the advantages discussed above and that overcomes the disadvantages and limitations associated with presently available automatic inflatable personal flotation devices and standard devices (i.e., non-automatic, pre-inflated), such as solid rings, cushions and horseshoes.

It is also an object of the present invention to provide a throwable emergency response automatic inflatable personal flotation device that is portable and easily utilized to automatically deploy an inflatable personal flotation bladder to safely and effectively support a person in a body of water so as to help prevent the person from drowning.

It is also an object of the present invention to provide a throwable emergency response automatic inflatable personal flotation device that utilizes an automatic water-activated actuating inflator assembly to operatively engage a piercing member and initiate flow from a container having pressurized gas so as to fill a bladder with the pressurized gas.

It is also an object of the present invention to provide a throwable emergency response automatic inflatable personal flotation device having a water-activated actuating inflator assembly comprising either a battery-operated electronic/pyrotechnic apparatus, destructible/dissolvable element apparatus and/or like water-activated apparatuses.

It is also an object of the present invention to provide a throwable emergency response automatic inflatable personal flotation device having a body member with a handle portion that is configured for comfortably gripping so as to allow a person to effectively throw the device and is configured to removably store one or more signal generating devices and/or emergency materials.

It is also an object of the present invention to provide a throwable emergency response automatic inflatable personal flotation device having a cover or sheath member that covers the bladder and body member of the device during storage and which easily breaks off or apart when the device contacts or is immersed in water.

It is also an object of the present invention to provide a throwable emergency response automatic inflatable personal flotation device having a bladder member with one or more handles thereon to assist a person in the water with holding on to the inflated bladder and to make it easier for another person to help retrieve the user/wearer from the water.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 2:
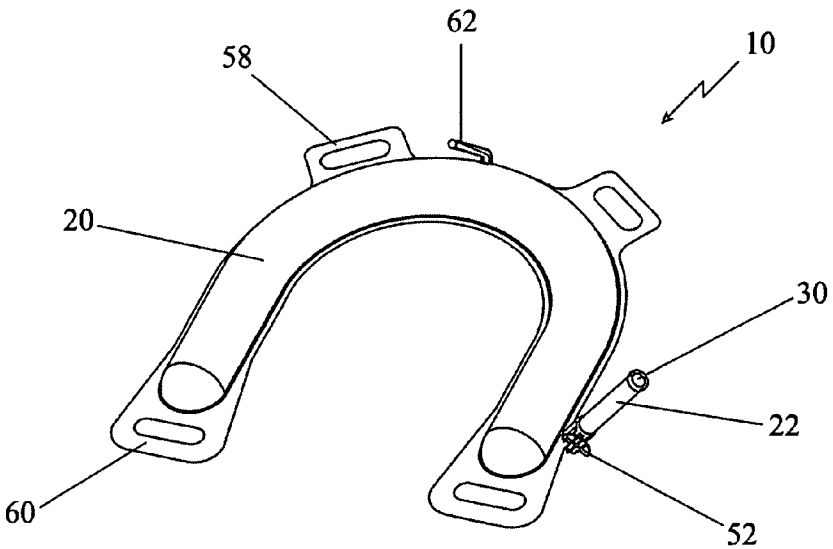
FIG. 2 is a perspective view of an activated automatic inflatable personal flotation device configured according to a preferred embodiment of the present invention with a horseshoe-shaped, air-filled bladder.
Figure 1:
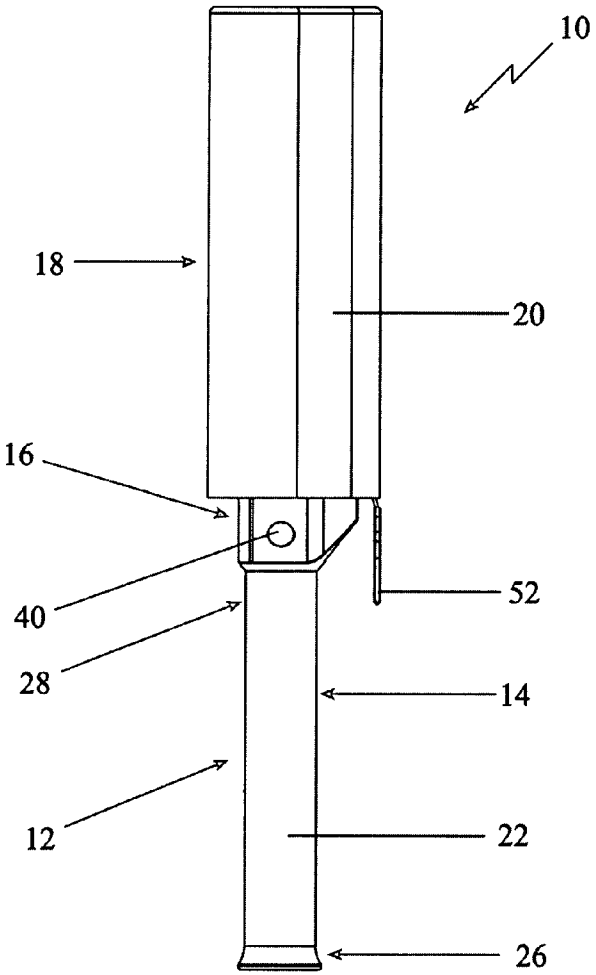
FIG. 1 is a side view of a throwable emergency response automatic inflatable personal flotation device configured according to a preferred embodiment of the present invention.

With reference to the figures where like elements have been given like numerical designations to facilitate the reader's understanding of the present invention, and particularly with reference to the embodiments of the throwable emergency response automatic inflatable personal flotation device of the present invention illustrated in the figures, various preferred embodiments of the present invention are set forth below. The enclosed description and drawings are merely illustrative of preferred embodiments and represent several different ways of configuring the present invention. Although specific components, materials, configurations and uses of the present invention are illustrated and set forth in this disclosure, it should be understood that a number of variations to the components and to the configuration of those components described herein and in the accompanying figures can be made without changing the scope and function of the invention set forth herein.

In the preferred embodiment of the throwable emergency response automatic inflatable personal flotation device of the present invention, shown in the figures, the automatic inflatable personal flotation device is identified generally as 10. FIGS. 1 through 4 included herewith show a preferred embodiment of the complete device, shown in its non-activated state in FIGS. 1, 3 and 4 and in its activated state in FIG. 2. FIGS. 5 through 8 show an incomplete (i.e., uncovered) views of device 10 to show certain components utilized therewith. The personal flotation device 10 of the present invention has a body member 12 having handle section 14, actuator section 16 and cylinder section 18 incorporated thereon. In the stored or non-activated state of device 10, actuator section 16 and cylinder section 18 are partially covered or enclosed by the uninflated personal flotation bladder 20, shown uninflated in FIG. 1 and inflated in FIG. 2. Flotation bladder 20 can be a variety of commonly available or specially configured air-fillable personal flotation bladders, including a ring or horseshoe shaped bladder (such as the horseshoe shaped flotation bladder 20 shown in FIG. 2) or other life preserver type of component that is configured to be placed around or grasped by a person in a body of water who is a potential drowning victim. The preferred shape for inflated flotation bladder 20 is the horseshoe shape shown in FIG. 2, which is known to be a common shape for personal flotation devices. Although not shown, those skilled in the art will recognize that personal flotation device 10 of the present invention can also be utilized with appropriately sized life vests, rafts and other bladder-types of flotation devices. Flotation bladder 20 is made out of materials suitable for holding a quantity of gas and withstanding the weather and environmental conditions likely to be encountered during its use and storage. Preferably, the material selected for flotation bladder 20 is suitably puncture resistant so as to not be easily damaged in storage or in use. Materials for flotation bladder 20 are well known to those skilled in the art and include such materials as various poly/cotton blends, nylon (i.e., a polyurethane coated nylon shell), neoprene and a variety of other materials, either alone or in various combinations.

In the preferred embodiment of the automatic inflatable personal flotation device 10 of the present invention, body member 12 is of single piece construction such that handle section 14, actuator section 16 and cylinder section 18 are integrally disposed on body member 12. Although the figures show the preferred embodiment as positioning cylinder section 18 at the opposite end of handle section 14, with actuator section 16 disposed therebetween, it should be understood by those skilled in the art that location of actuator section 16 and cylinder section 18 can be switched, with cylinder section 18 disposed between actuator section 16 and handle section 14. In the preferred embodiment, body member 12 is a substantially baton-shaped frame (i.e., similar to batons used in track and field events) that supports the various components of device 10 thereon. Handle section 14 comprises a handle 22 that is sized and configured to be easily gripped by the typical person who may be throwing device 10 to a potential drowning victim. Because body member 12 functions as both a support frame and the delivery system for device 10, it must be made out of materials suitable for the intended uses of device 10. A preferred material for body member 12 is a generally lightweight but sturdy plastic that is suitable for use in an outdoor, water environment, including salt water. An example of a preferred material is PC/ABS plastic due to its ease in manufacturing, cost of the material and its suitability for the conditions under which device 10 will be utilized. As those skilled in the art will know, various other materials are also suitable for body member 12. The use of heavy, bulky and/or easily corroded materials should be avoided.

Figure 4:
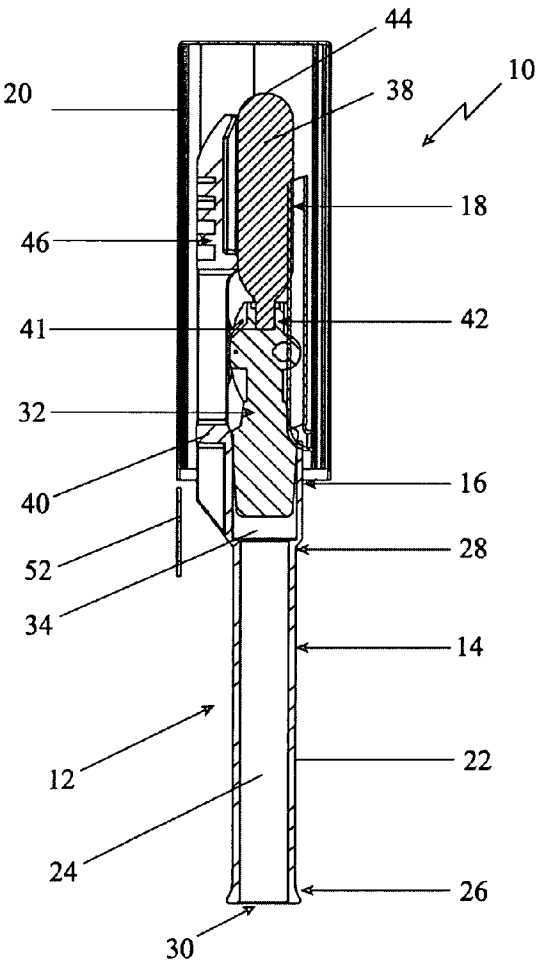
FIG. 4 is a cross-sectional side view of the automatic inflatable personal flotation device of FIG. 3 taken through line A—A.
Figure 3:
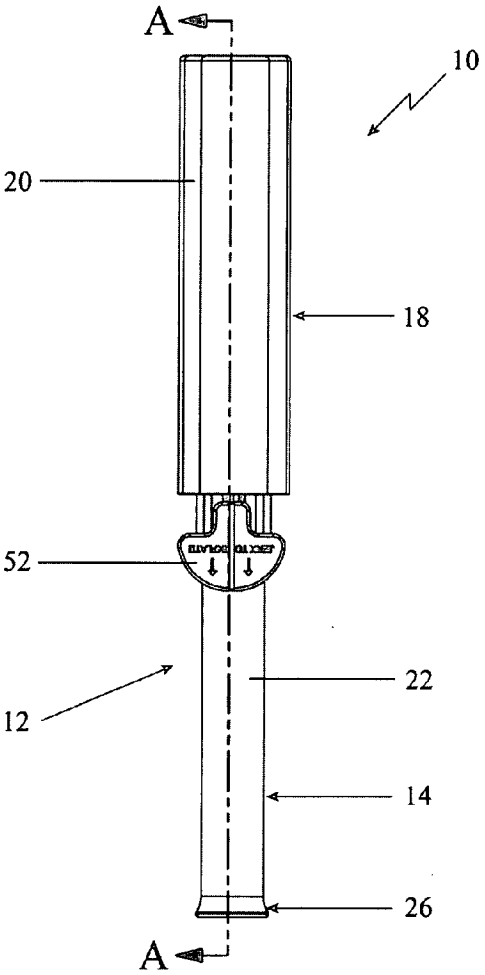
FIG. 3 is a back view of the automatic inflatable personal flotation device of FIG. 1 particularly showing the manual activation mechanism.

In the preferred embodiment, handle 22 is configured with an interior chamber 24, best shown in FIG. 4, for storing one or more signal generating devices (not shown), including but not limited to a GPS locator, strobe light, liquid florescent light, dye marker, whistle, air horn, smoke signal and/or distress flag, and/or one or more emergency materials, such as shark repellant, medicines, first aid supplies and/or a knife. To facilitate use of handle 22 for storage of signal generating devices and/or emergency materials, it is preferred that first end 26 of handle 22 is open or openable to allow access to chamber 24 and second end 28 of handle 22 is closed to prevent contact with actuator section 16. In one embodiment, first end 26 of handle 22 has opening 30 that allows access to chamber 24 for storing and removing signal generating devices and/or emergency materials as desired or necessary. If desired, first end 26 of handle 22 can be provided with a removable cover or openable "door" to block opening 30 when access to the signal generating devices and/or emergency materials in chamber 24 is not required. Any such cover or door should be relatively easily to remove or open when access to chamber 24 is necessary. If desired, handle 22 can be configured with one or more gripping mechanisms (not shown) that facilitate the person throwing device 10 getting a good grip on handle 22 so as to effectuate a better throw. Such gripping mechanisms are generally well known and include finger grips and/or a plurality of grooves along the length of handle 22.

To fill flotation bladder 20 with gas, the automatic inflatable personal flotation device 10 of the present invention has an automatic inflator assembly 32 pneumatically connected to flotation bladder 20 and configured to automatically inflate flotation bladder 20 when immersed in water. As shown in the drawings, particularly FIG. 4, automatic inflator assembly 32 is securely positioned in actuator section 16 of body member 12. In the preferred embodiment, inflator assembly 32 is disposed between handle 22 and cylinder section 18. As with the patents referenced above, the disclosures of which are incorporated herein, a preferred water-actuated, automatic inflator assembly 32 has a mechanism for driving a piercing pin or member into the pierceable or frangible seal of a cylinder of pressurized gas to cause the gas to flow through a manifold system to the flotation bladder 20 and rapidly fill bladder 20 with the gas. As set forth in these patents, there are two primary inflator assembly mechanisms known in the prior art, the battery operated electrical mechanism and the water destructible or dissolvable element mechanism. Both of these types of mechanisms operate to rapidly release pressurized gas from a source of such gas into flotation bladder 20 and, as such, either of these types of mechanisms are suitable for use as automatic inflator assembly 32 for device 10. Because automatic inflatable personal flotation device 10 of the present invention is configured for emergency use to save someone from drowning, it is important to select an inflator assembly 32 that is reliable under the likely usage conditions, suitable for long term storage until it is needed and able to rapidly activate so as to transfer substantially all of the pressurized air to flotation bladder 20.

In the preferred embodiment, the present invention 10 utilizes an inflator assembly 32 that is of the battery operated electrical mechanism type, such as described in U.S. Pat. No. 4,768,128 to Jankowiak, et al. (such as is available from Conax Florida Corporation) and U.S. Pat. No. 5,400,922 to Weinheimer, et al. As set forth in these patents, the inflator assemblies utilize a battery supplied source of electricity and either an explosive primer or a spring to drive the piercing pin into the pierceable seal or closure of the source of pressurized air (i.e., a cylinder). Other electrically operated mechanisms for inflator assembly 32 are also adaptable for use with device 10 of the present invention. These types of mechanisms are preferred due to their much longer "shelf" life than the destructible or dissolvable element types (i.e., five years or more compared to only six or so months). In addition, the electrically operated mechanisms for inflator assembly 32 virtually eliminates some of the known problems with destructible or dissolvable elements, such as premature firing due to moisture and/or vibration breaking down the element and causing the spring to drive the pierceable pin into the supply of pressurized gas. Although the electrically operated mechanism is generally preferred for inflator assembly 32, the destructible or dissolvable element type can also be utilized for inflator assembly 32 for device 10 of the present invention. In fact, in some circumstances it may be that the destructible or dissolvable element type of mechanism may be preferred for inflator assembly 32.

Figure 6:
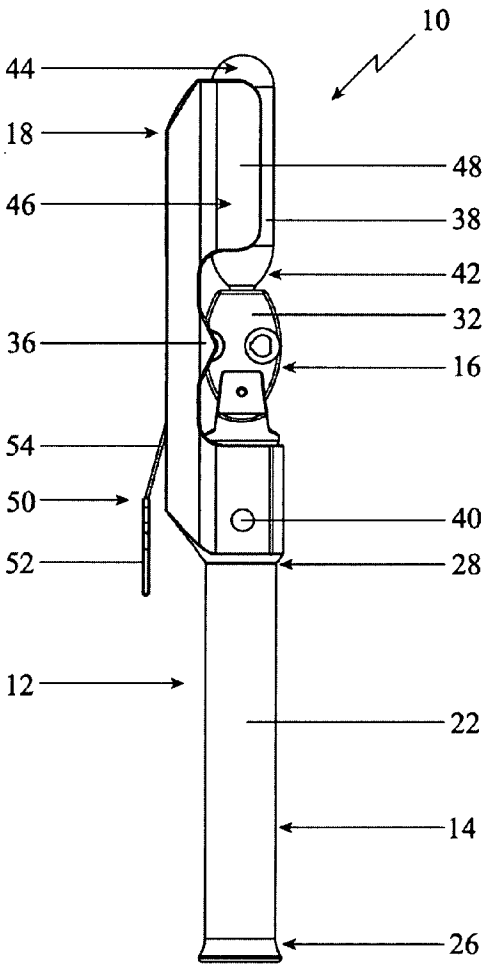
FIG. 6 is a side view of the automatic inflatable personal flotation device of FIG. 5.
Figure 5:
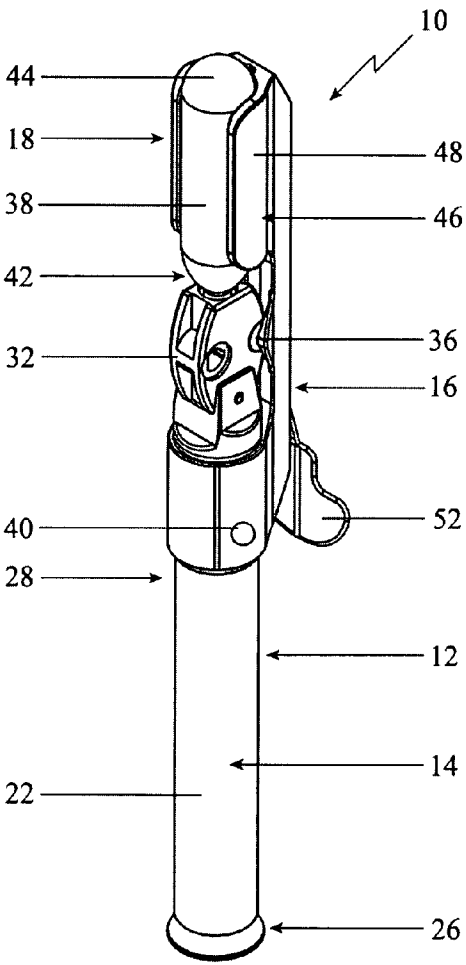
FIG. 5 is a perspective view of the automatic inflatable personal flotation device of FIG. 1 with the personal flotation bladder removed from the device to show the configuration of the components covered thereby.

As shown in the drawings, inflator assembly 32 is secured to body member 12 at actuator section 16. In one embodiment, inflator assembly 32 is securely disposed inside flooding chamber 34, shown in FIG. 4, of actuator section 16 just above second end 28 of handle 22. To ensure that inflator assembly 32 is properly positioned on body member 12, the preferred embodiment of device 10 includes one or more actuator positioning tabs 36 at actuator section 16, as best shown in FIGS. 5 and 6. Actuator positioning tabs 36 are in configured to be in cooperative relationship with inflator assembly 32 to properly position inflator assembly in actuator section 16 relative to the source of pressurized air, such as cylinder 38. To cause inflator assembly to activate when exposed to water, actuator section 16 has one or more flooding openings 40 configured to allow water to flow into flooding chamber 34 and immerse the actuating portion of inflator assembly 32 in water, thereby causing it to activate and allow pressurized gas to flow from cylinder 38 to flotation bladder 20, which is operatively and pneumatically connected to inflator assembly 32. As known to those skilled in the art, it is important that flooding openings 40 be sufficiently large to rapidly flood flooding chamber 34 so as to quickly expose inflator assembly 32 to water and cause it to activate the piercing pin to release pressurized gas from cylinder 38.

To fill flotation bladder 20, as shown in FIG. 2, the automatic inflatable personal flotation device 10 of the present invention utilizes a cylinder 38 as a source of pressurized gas. Cylinder 38 is disposed in cylinder section 18 of body member 12. In the preferred embodiment, cylinder 38 is a carbon dioxide cartridge containing pressurized carbon dioxide gas. Use of such a cylinder 38 as a source of pressurized gas is well known in the art. As described in the patents referenced above, the typical pressurized gas cylinder 38 has a pierceable or frangible seal 41 at first end 42, opposing closed end 44, that is positioned in cooperating relationship with inflator assembly 32. First end 42 of cylinder 38 is positioned such that when water contacts inflator assembly 32 to activate the electrically activated or destructible/dissolvable element operating mechanism of inflator assembly 32 to drive the piercing pin into the pierceable or frangible seal 41 and allow the pressurized gas to flow from cylinder 38 through the manifold of inflator assembly 32 to flotation bladder 20. Various commercially available carbon dioxide pressurized canisters can be utilized for cylinder 38. If desired, a variety of other gases may also be suitable for use with cylinder 38 of the device 10 of the present invention. Preferably, any such gas should be nontoxic, nonflammable and selected for its ability to rapidly and effectively fill flotation bladder 20.

In the preferred embodiment, cylinder section 18 of body member 12 has a cylinder support bracket 46 configured to securely hold cylinder 38 in cylinder section 18. In one embodiment, best shown in FIGS. 5 through 8, cylinder support bracket 46 comprises a pair of outwardly extending bracket members 48 that are sized and configured to securely hold cylinder 38 in cylinder section 18. In a preferred embodiment, cylinder support bracket 46 removably, but securely, holds cylinder 38 in cylinder section 18 so the user/owner may replace cylinder 38 with a new or refilled cylinder 38 after usage. In another embodiment of the present invention, cylinder 38 is fixedly secured inside cylinder support bracket 46 such that device 10 is configured for a single use that is to be disposed after such use.

Figure 8:
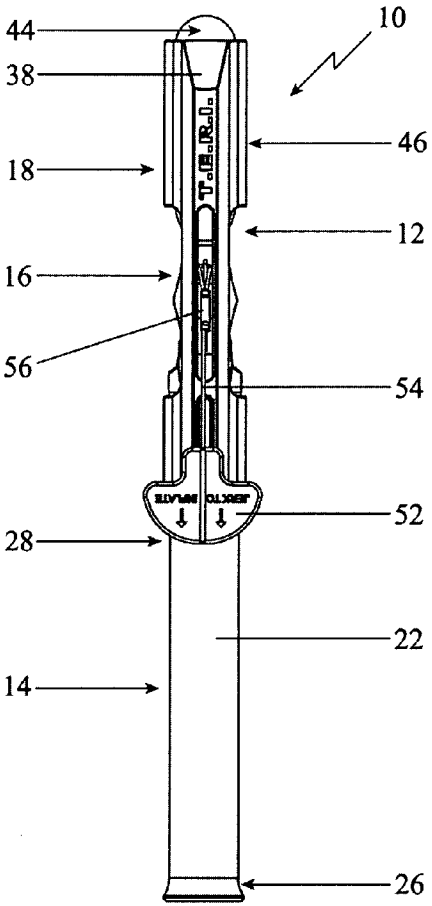
FIG. 8 is a back view of the automatic inflatable personal flotation device of FIG. 5.
Figure 7:
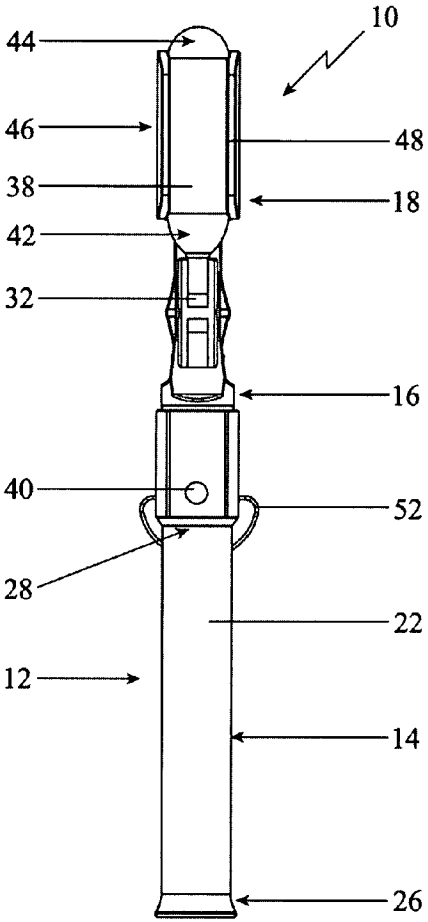
FIG. 7 is a front view of the automatic inflatable personal flotation device of FIG. 5.

In case of malfunction of the automatic inflator assembly 32, device 10 of the present invention is provided with a manual inflation mechanism 50, best shown in FIGS. 6 and 8, having a pull handle 52 operatively connected by cord member 54 to inflator assembly 32. In the preferred embodiment, manual inflation mechanism 50 is a rip cord type of mechanism that is operatively connected to inflator assembly 32 so as to rapidly activate the electrically activated or destructible/dissolvable element operating mechanism of inflator assembly 32 to drive the piercing pin into the pierceable or frangible seal 41 and allow the pressurized gas to flow from cylinder 38 through the manifold of inflator assembly 32 to flotation bladder 20. As known to those skilled in the art, and as set forth in the patents referenced above, when pull handle 52 is pulled, cord member 54 activates inflator assembly 32 to fill flotation bladder 20 with pressurized gas from cylinder 38. Although inflator assembly 32 should be chosen such that the likelihood of needing to utilize manual inflation mechanism 50 is remote, because the device is configured for use in emergency situations to avoiding a drowning death, the back-up manual inflation mechanism 50 should be included with the personal flotation device 10 of the present invention. In the preferred embodiment of the present invention, actuator section 16 has a pull slot 56, show in FIG. 8, incorporated into body member 12 through which cord member 54 extends outwardly of body member 12. Pull slot 56 is sized and configured to permit unobstructed movement of cord member 54. Unlike some prior art automatic inflation devices that have a back-up manual system, access to manual inflation mechanism 50 of the present invention is not blocked by nor requires any removal of any component of device 10 before use.

The preferred embodiment of the automatic inflatable personal flotation device 10 of the present invention utilizes flotation bladder 20 configured as shown in FIG. 2 into a generally horseshoe shape and having one or more user handles 58, one or more rescue handles 60 and at least one air fill tube 62 in airflow communication with the interior chamber of flotation bladder 20. User handles 58, two of which are shown in FIG. 2, are preferably positioned on the closed side of the generally horseshoe-shaped flotation bladder 20 and configured to be particularly useful for the person in the water to use to more securely hold onto flotation bladder 20 while in the water. Although not shown, those skilled in the art will know that flotation bladder 20 configured in the horseshoe shape shown in FIG. 2 can include one or more tie members at the open end thereof that are useful for securing flotation bladder around the person's body. Rescue handles 60, shown at the open ends of the horseshoe-shaped flotation bladder 20 are useful for a person who is rescuing the potential drowning victim to grab onto so as to pull the drowning person out of the water, with the closed end of flotation bladder 20 against the person's back. Preferably, user handles 58 and rescue handles 60 are both sufficiently well attached to flotation bladder 20 that a rescuer can grab onto either or a combination of both handles 58 and 60 to pull the potential drowning victim out of the water. Air fill tube 62 can be one of the many types of air tubes that are commercially available that allow a person to use his or her mouth to blow air into the interior chamber (not shown) of flotation bladder 20. As well known in the art, some of these devices have a removable cap member that closes fill tube 62 and others utilize a valve system that has a self-closing mechanism which allows air to flow in fill tube 62 when the person is blowing, but prevents air from escaping flotation bladder 20 when he or she stops. As shown in FIG. 2, air fill tube is beneficially located near the center of the closed end of the horseshoe-shaped flotation bladder 20 for easy access thereto by a person holding on to flotation bladder 20.

Figure 9:
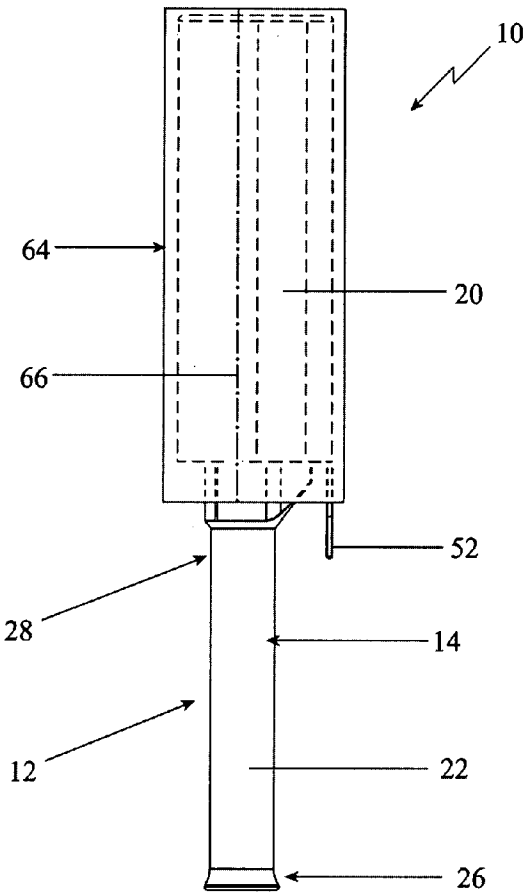
FIG. 9 is a side view of the automatic inflatable personal flotation device of FIG. 1 covered by a sheath member.

As shown in FIG. 9, the preferred embodiment of the present invention includes a covering sheath 64 that substantially covers flotation bladder 20 when it is wrapped around cylinder section 16 and actuator section 14 to secure flotation bladder 20 on body member 12. Preferably, sheath 64 comprises a very thin but strong material, such as a foam material approximately 0.125 inches thick, that is sufficiently strong to keep flotation bladder 20 in a rolled, compact condition around body member 12 to prevent flotation bladder 20 from unraveling when thrown. In addition to preventing the unraveling of flotation bladder 20, sheath 64 provides a more aerodynamic shape to device 10 that will facilitate the rescuer throwing device 10 a further distance than may otherwise be achieved. To facilitate expansion of flotation bladder 20 during inflation, the preferred sheath 64 includes a compromised seam 66, shown as the alternating dot and dashed line in FIG. 9, that will easy separate during inflation. If desired, the foam material of sheath 64 can also cover handle 22 to provide an improved gripping action for handle 22 and increased buoyancy before inflation.

To protect the inflatable personal flotation device 10 when not in use, a storage container (not shown) is configured to removable receive device 10. In one embodiment, the storage container is a generally tubular shaped member having an open end and an opposing closed end and is made out of a high performance polyester tube that is manufactured to be generally chemical, fuel, heat, ultraviolet light and crush resistant. Ideally, the storage container or tube provides a highly protective environment so that device 10 can be stored or carried virtually anywhere.

In one preferred exemplary configuration, body member is approximately 13 inches long that, when all of the components are compiled thereon, is configured to be beneficially weighted and balanced to optimize the throwing of device 10. Handle 22 can be approximately 5 inches long and have an outside diameter of approximately 1.25 inches, which has been found comfortable for most persons to grasp and effectively throw, and an inside diameter of 1.0 inch for chamber 24. Actuator section 16 can be approximately 5.5 inches long and cylinder section can be approximately 2.5 inches long. In one example configuration, device 10 weighs approximately 16 ounces. As such, device 10 is suitable for being carried in backpacks, beach bags, fire trucks, police cars, life guard vehicle, rescue vehicle, aircraft and boats (preferably inside the storage container described above). With the configuration similar to that described above, device 10 can be thrown as far as 150 feet or more. Tests by the inventor indicate an average throwing distance of 110 feet for adult males, 65 feet for adult females and 40 feet for a nine year old girl. Typically, the average distance an adult male can throw a traditional ring or cushion is about 40 feet.

Figure 10:
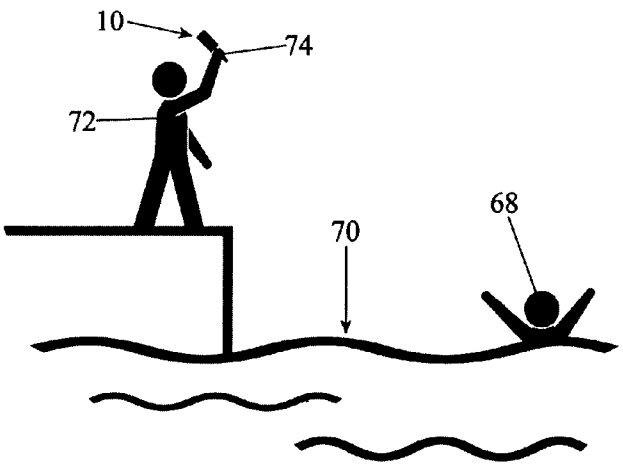
FIG. 10 is an illustration showing a rescuer preparing to throw the automatic inflatable personal flotation device of FIG. 9 to a person in a body of water.

In use, as shown in FIG. 10, when a person 68 in a body of water 70 is in need of being rescued to avoid drowning, another person, the rescuer 72, would reach into the storage container and grab device 10 by handle 22 and remove device 10 from the storage container. Because no preparation is required, the rescuer 72 merely has to hold the handle 22 of device 10 by his or her hand 74 and throw device 10 in the direction of the person 68 in the water 70. Sheath 64 keeps flotation bladder 20 secured tightly around body member 12 while device 10 travels through the air. When device 10 hits the water, water will flow through flooding openings 40 into flooding chamber 34 to activate automatic inflator assembly 32. Once activate, the water-actuated, automatic inflator assembly 32, whether the battery operated electrical mechanism or the water destructible or dissolvable element type of mechanism, will drive the piercing pin into the pierceable or frangible seal 41 of cylinder 38 to cause the pressurized gas therein to flow through the manifold system to flotation bladder 20 and rapidly fill bladder 20 with the gas. The inflation of flotation bladder 20 will tear apart seam 66 of sheath 64 and provide the potential drowning victim 68 with an inflated bladder 20, as shown in FIG. 2, to support himself or herself in the water 70 until a more permanent rescue can be effectuated. The person 68 in the water 70 can grasp user handles 58 to keep flotation bladder 20 close to his or her body and rescuer 72 can grasp rescue handles 60 to pull victim 68 out of the water 70. If the automatic inflator assembly 32 fails to operate, the drowning person 68 can manually activate inflator assembly 32 by pulling on pull handle 52, attached to cord member 54, to begin the inflation process. If flotation bladder 20 fails to achieve or maintain its inflated condition, the drowning person 68 can blow additional air into flotation bladder 20 through air fill tube 62. In the preferred embodiment, automatic inflatable personal flotation device 10 is configured such that when flotation bladder 20 is filled with air from cylinder 38 after activation of inflator assembly 32, handle section 14 of body member 12 extends in a generally upward direction, as shown in FIG. 2, to allow easy access to the signal generating devices and/or emergency materials stored in chamber 24 of handle 22. In case of a maritime or other large scale water disaster where many people may be in the water, automatic inflatable personal flotation device 10 of the present invention is suitable for being dropped in large quantities near the site of the disaster. For instance, if a cruise ship has trouble and must be abandoned, a fast moving aircraft, such as a private or military jet, can be sent to drop a large quantity of flotation devices 10 near the site of the disaster. Because of the configuration of the present invention 10, it would not be necessary to have a slower moving aircraft, such as a helicopter, make the drop to effectuate the rescue. Once dropped, the flotation devices 10 will inflate after contact with the water, thereby providing the people in the water with a device to better sustain themselves in the water until a more permanent rescue is effectuated.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to assembly, materials, size, shape and use. For instance, some of the components described above can be made integral with each other to reduce the number of separate components and various replacement components can be utilized that perform the same function as those described above.

What is claimed is:

1. An automatic inflatable personal flotation device for use in a body of water, comprising:

a substantially baton-shaped body member having a handle section, an actuator section and a cylinder section;

a handle at said handle section of said body member;

a cylinder at said cylinder section, said cylinder containing a pressurized gas therein, said cylinder having a seal at a first end of said cylinder, said seal configured to be pierceable or frangible;

a cylinder support bracket at said cylinder section to secure said cylinder on said body member;

an inflator assembly at said actuator section, said inflator assembly at least partially disposed in a flooding chamber having one or more flooding openings connected thereto to allow water from said body of water to contact said inflator assembly, said inflator assembly configured to operatively contact said source of pressurized gas to release said pressurized gas therefrom; and a flotation bladder disposed about at least a portion of said body member and pneumatically connected to said inflator assembly, said flotation bladder configured to be filled by said pressurized gas when released from said source of pressurized gas.

2. The automatic inflatable personal flotation device according to claim 1, wherein said handle has an interior chamber, said interior chamber accessible through an opening in said handle.

3. The automatic inflatable personal flotation device according to claim 1, wherein said inflator assembly has an operable mechanism selected from the group consisting of battery operated electrical mechanism, water destructible mechanism and dissolvable element mechanism.

4. The automatic inflatable personal flotation device according to claim 1, wherein said cylinder support bracket has a pair of outwardly extending bracket members.

5. The automatic inflatable personal flotation device according to claim 1, wherein said cylinder support bracket removably secures said cylinder on said body member.

6. The automatic inflatable personal flotation device according to claim 1, wherein said actuator section has one or more actuator positioning tabs in cooperating relationship with said inflator assembly to properly position said inflator assembly in said actuator section.

7. The automatic inflatable personal flotation device according to claim 1, wherein said flotation bladder has an air fill tube in airflow communication with the interior of said flotation bladder for use to fill said flotation bladder with air.

8. The automatic inflatable personal flotation device according to claim 1, wherein said flotation bladder comprises one or more handles selected from the group consisting of user handles and rescue handles.

9. The automatic inflatable personal flotation device according to claim 1 further comprising means for manual inflation of said flotation bladder, said manual inflation means operatively connected to said inflator assembly to allow manual operation of said inflator assembly to fill said flotation bladder with said pressurized gas.

10. The automatic inflatable personal flotation device according to claim 9, wherein said manual inflation means comprises a pull handle and a cord member, said cord member extending outwardly through a pull slot in said body member.

11. The automatic inflatable personal flotation device according to claim 1 further comprising a covering sheath configured to at least cover said flotation bladder and maintain said flotation bladder around said body member until said device contacts said body of water.

12. The automatic inflatable personal flotation device according to claim 11, wherein said covering sheath has a compromised seam configured to separate said covering sheath and release said flotation bladder.

13. An automatic inflatable personal flotation device for use by a rescuer to assist a person in a body of water, said flotation device comprising:

a substantially baton-shaped body member having a handle section, an actuator section and a cylinder section;

a handle at said handle section of said body member, said handle configured to be gripped by the hand of said rescuer and thrown by said rescuer to said person in said body of water;

a cylinder at said cylinder section, said cylinder containing a pressurized gas therein, said cylinder having a seal at a first end of said cylinder, said seal configured to be pierceable or frangible;

an inflator assembly at said actuator section, said inflator assembly at least partially disposed in a flooding chamber having one or more flooding openings to allow water from said body of water to contact said inflator assembly, said inflator assembly having an operable mechanism configured to operatively contact said cylinder to release said pressurized gas therefrom, said operable mechanism selected from the group consisting of battery operated electrical mechanism, water destructible mechanism and dissolvable element mechanism;

a flotation bladder disposed about at least a portion of said body member and pneumatically connected to said inflator assembly, said flotation bladder configured to be filled by said pressurized gas when released from said cylinder to assist said person in said body of water; and a covering sheath configured to at least cover said flotation bladder and maintain said flotation bladder around said body member until said device contacts said body of water, said covering sheath having a compromised seam configured to separate said covering sheath and release said flotation bladder.

14. The automatic inflatable personal flotation device according to claim 13 further comprising means for manual inflation of said flotation bladder, said manual inflation means operatively connected to said inflator assembly to allow manual operation of said inflator assembly to fill said flotation bladder with said pressurized gas.

15. The automatic inflatable personal flotation device according to claim 13, wherein said cylinder is secured on said body member by a cylinder support bracket at said cylinder section.

16. The automatic inflatable personal flotation device according to claim 13, wherein said actuator section has one or more actuator positioning tabs in cooperating relationship with said inflator assembly to properly position said inflator assembly in said actuator section.

17. An automatic inflatable personal flotation device for use by a rescuer to assist a person in a body of water, said flotation device comprising:

a substantially baton-shaped body member having a handle section, an actuator section and a cylinder section;

a handle at said handle section of said body member, said handle configured to be gripped by the hand of said rescuer and thrown by said rescuer to said person in said body of water;

a cylinder at said cylinder section, said cylinder containing a pressurized gas therein, said cylinder having seal at a first end of said cylinder, said seal configured to be pierceable or frangible, a cylinder support bracket at said cylinder section to secure said cylinder on said body member;

an inflator assembly at said actuator section, said inflator assembly at least partially disposed in a flooding chamber having one or more flooding openings to allow water from said body of water to contact said inflator assembly, said inflator assembly having an operable mechanism configured to operatively contact said cylinder to release said pressurized gas therefrom, said operable mechanism selected from the group consisting of battery operated electrical mechanism, water destructible mechanism and dissolvable element mechanism;

a flotation bladder disposed about at least a portion of said body member and pneumatically connected to said inflator assembly, said flotation bladder configured to be filled by said pressurized gas when released from said cylinder to assist said person in said body of water;

means for manual inflation of said flotation bladder, said manual inflation means operatively connected to said inflator assembly to allow manual operation of said inflator assembly to fill said flotation bladder with said pressurized gas; and a covering sheath configured to at least cover said flotation bladder and maintain said flotation bladder around said body member until said device contacts said body of water.

18. The automatic inflatable personal flotation device according to claim 17, wherein said actuator section has one or more actuator positioning tabs in cooperating relationship with said inflator assembly to properly position said inflator assembly in said actuator section.

19. An automatic inflatable personal flotation device for use in a body of water, comprising:

a substantially baton-shaped body member having a handle section, an actuator section and a cylinder section;

a handle at said handle section of said body member;

a source of pressurized gas at said cylinder section, said source of pressurized gas containing a pressurized gas therein;

an inflator assembly at said actuator section, said inflator assembly at least partially disposed in a flooding chamber having one or more flooding openings connected thereto to allow water from said body of water to contact said inflator assembly, said inflator assembly configured to operatively contact said source of pressurized gas to release said pressurized gas therefrom;

one or more actuator positioning tabs at said actuator section, said one or more actuator positioning tabs in cooperating relationship with said inflator assembly to properly position said inflator assembly in said actuator section; and a flotation bladder disposed about at least a portion of said body member and pneumatically connected to said inflator assembly, said flotation bladder configured to be filled by said pressurized gas when released from said source of pressurized gas.

20. The automatic inflatable personal flotation device according to claim 19 further comprising a covering sheath configured to cover said flotation bladder and maintain said flotation bladder around said body member until said device contacts said body of water, said covering sheath having a compromised seam configured to separate said covering sheath and release said flotation bladder.

* * * * *